US009903138B2

(12) United States Patent
Bauer

(10) Patent No.: US 9,903,138 B2
(45) Date of Patent: Feb. 27, 2018

(54) SELF-CONTAINED LOCK/UNLOCK INDICATOR FOR INSTALLATION WITHIN A VEHICLE DOOR PANEL

(71) Applicant: Ford Global Technologies, LLC, Dearborn, MI (US)

(72) Inventor: Brian Joseph Bauer, Howell, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 161 days.

(21) Appl. No.: 14/919,870

(22) Filed: Oct. 22, 2015

(65) Prior Publication Data

US 2017/0114568 A1 Apr. 27, 2017

(51) Int. Cl.
*E05B 41/00* (2006.01)
*E05B 85/08* (2014.01)

(52) U.S. Cl.
CPC ..... *E05B 41/00* (2013.01); *E05B 85/08* (2013.01)

(58) Field of Classification Search
CPC ..... E05B 41/00; E05B 65/06; E05B 81/25; E05B 85/08; Y10T 70/5889; Y10T 292/03
USPC ..... 116/279; 70/237, 255; 292/DIG. 23
See application file for complete search history.

(56) References Cited

U.S. PATENT DOCUMENTS 2,834,628 A * 5/1958 Paparelli ..... E05B 85/08 292/347
3,455,592 A * 7/1969 Bela ..... E05B 85/08 292/347
3,558,168 A * 1/1971 Andres ..... E05B 85/08 292/347
3,943,352 A * 3/1976 Pena May ..... B60Q 9/001 200/314
4,169,620 A * 10/1979 Pacura ..... E05B 85/08 292/1
4,674,780 A * 6/1987 Weinerman ..... E05B 85/08 292/1
5,794,995 A 8/1998 Creesy et al.
7,669,915 B2 3/2010 Lipski
8,672,369 B2 3/2014 Mazur et al.
2011/0304165 A1 12/2011 Mette

FOREIGN PATENT DOCUMENTS

DE 2852310 A1 * 6/1980 ..... E05B 85/08
DE 102008027345 1/2009
EP 1347132 A1 * 9/2003 ..... E05B 41/00
KR 2019980042409 9/1998

OTHER PUBLICATIONS

English translation of DE 2852310 A1.*

* cited by examiner

*Primary Examiner* — Daniel S Larkin
*Assistant Examiner* — Irving A Campbell
(74) *Attorney, Agent, or Firm* — Jason Rogers; Price Heneveld LLP

(57) ABSTRACT

A vehicle door includes a lock indicator assembly having an operable housing and an internal locking pin engaged with the operable housing and biased to a downward position within the operable housing, an interior door panel having a receptacle, wherein the operable housing is received within the receptacle and a lock rod operable to engage an underside of the operable housing and move the locking pin to an upward position.

8 Claims, 7 Drawing Sheets

SELF-CONTAINED LOCK/UNLOCK INDICATOR FOR INSTALLATION WITHIN A VEHICLE DOOR PANEL

FIELD OF THE INVENTION

The present invention generally relates to locked and unlocked indication mechanisms for vehicle doors. More specifically, the device relates to a self-contained door lock/unlock indicator that can be inserted within a door panel during manufacture of the vehicle door.

BACKGROUND OF THE INVENTION

Various automobiles include door lock/unlock indicators that include a cap that is configured to protrude from a door panel of a vehicle when the door is unlocked and further configured to retract within the door panel when the door is locked. Such a mechanism usually indicates to a user, whether inside or outside the vehicle, whether the door is locked or unlocked.

SUMMARY OF THE INVENTION

According to one aspect of the present invention, a vehicle door includes a lock indicator assembly having an operable housing and an internal locking pin engaged with the operable housing and biased to a downward position within the operable housing, an interior door panel having a receptacle, wherein the operable housing is received within the receptacle and a lock rod operable to engage an underside of the operable housing and move the locking pin to an upward position.

According to another aspect of the present invention, a lock indicator assembly for a vehicle door includes upper and lower housing portions biased away from one another to an extended state and a locking pin extending from the lower housing portion and through the upper housing portion, wherein the upper and lower housing portions are operable to a compressed state through operation of a lock rod against an underside of the lower housing portion.

According to another aspect of the present invention, a method of assembling a vehicle door includes steps of providing a door having an outer trim panel, an inner metal panel and a lock rod disposed within a door cavity defined by the inner metal panel. The lock rod selectively extends through the inner metal panel. The method also includes the step of proving an integral lock indicator assembly having upper and lower housing portions biased away from one another to an extended state, and a locking pin extending from the lower housing portion and through the upper housing portion and disposing the integral lock indicator assembly into a receptacle defined within the outer trim panel. The lower housing portion is positioned proximate the lock rod. The upper and lower housing portions are operable to a compressed state through operation of the lock rod against an underside of the lower housing portion. Upward motion of the lock rod presses the lower housing portion to the compressed state and moves the locking pin to an upward position, and wherein downward movement of the lock rod allows the lower housing portion to be biased to the extended state such that the locking pin is biased to a lowered position.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
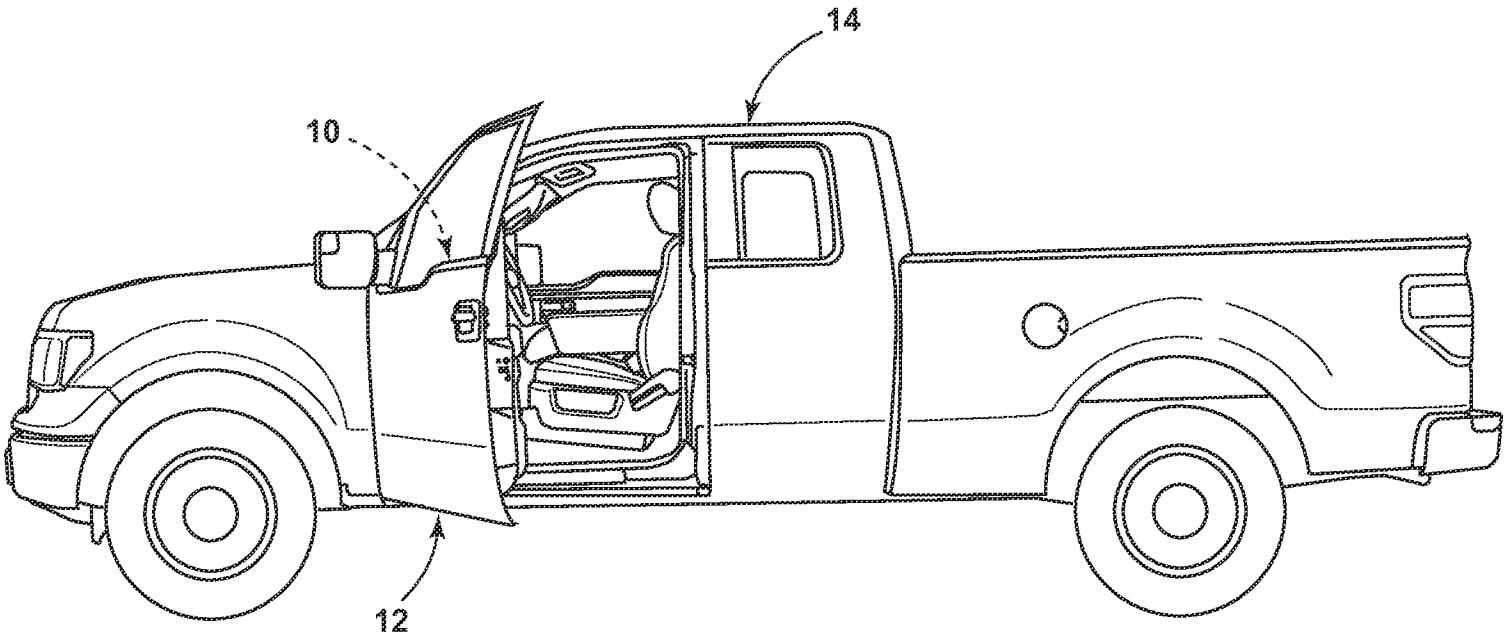
FIG. 1 is a side perspective view of a vehicle incorporating an aspect of the integral door lock indicator assembly.
Figure 2:
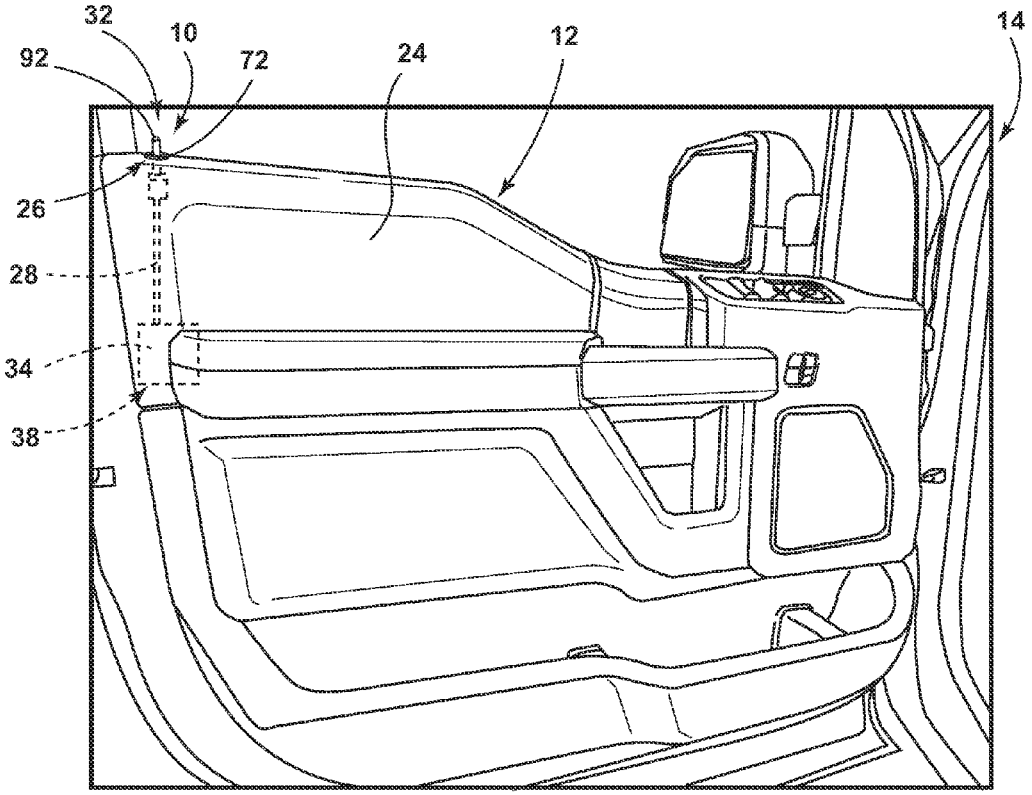
FIG. 2 is a side perspective view of a vehicle door inner panel incorporating an aspect of the integral door lock indicator assembly.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As shown in FIGS. 1-6, reference numeral 10 generally refers to an integral door lock indicator assembly that can be installed within the vehicle door 12 of a vehicle 14. The vehicle door 12 includes a lock indicator assembly 10 having an operable housing 16 and an internal locking pin 18 that is engaged with the operable housing 16. The operable housing 16 is biased to a lowered or downward position 20 by a biasing mechanism 22. An interior door panel 24 of the vehicle door 12 includes a receptacle 26, wherein the operable housing 16 is received within the receptacle 26. A lock rod 28 of the vehicle door 12 is engaged to an underside 30 of the operable housing 16 and is adapted to move the locking pin 18 from the downward position 20 to a raised or upward position 32. The lock rod 28 is engaged with a locking mechanism 34 such that when the locking mechanism 34 is in a locked state 36, the lock rod 28 is operated downward such that the operable housing 16 is biased by the biasing mechanism 22 toward the downward position 20 to indicate to the user that the locking mechanism 34 is in the locked state 36. When the locking mechanism 34 is in the unlocked state 38, the lock rod 28 is operated upward such that the lock rod 28 engages the underside 30 of the operable housing 16 and moves the operable housing 16 to the upward position 32 to visually indicate that the locking mechanism 34 of the vehicle door 12 is in the unlocked state 38.

Referring again to FIGS. 1-5, the vehicle door 12 can include an internal sheet metal 50 that is offset from the interior door panel 24. In this manner, the operable housing 16 can engage a top surface 52 of the internal sheet metal 50 to define the downward position 20 that indicates that the locking mechanism 34 is in the locked state 36. According to the various embodiments, the internal sheet metal 50 can include a rod aperture 54 through which the lock rod 28 extends to operate a lower housing portion 56 of the operable housing 16 from the downward position 20 to the upward position 32.

It is further contemplated that, in various embodiments, the lock rod 28 can be attached to the underside 30 of the operable housing 16 such that the lock rod 28 is in continual engagement with the underside 30 of the operable housing 16 as the lock rod 28 is operated to move the operable housing 16 between the downward and upward positions 20, 32. In such an embodiment, it is contemplated that the lock rod 28 can be the only source of movement of the operable housing 16 such that no biasing mechanism 22 is included.

According to the various embodiments, it is contemplated that the integral door lock indicator assembly 10 can be a self-contained operable mechanism that can be installed within the vehicle door 12 during manufacture. Accordingly, the operable housing 16, internal locking pin 18, biasing mechanism 22, and other components of the lock indicator assembly 10 can be premanufactured and/or pre-assembled as a unit that can be installed as an integral piece within the vehicle door 12 during manufacture of the vehicle door 12. As such, the integral door lock indicator assembly 10 can be positioned relative to the interior door panel 24, internal sheet metal 50 and lock rod 28 of the vehicle door 12 instead of the various components of a conventional indicator being installed and manufactured along with the other components of the vehicle door 12.

Referring again to FIGS. 1-7, it is contemplated that the operable housing 16 can include an upper housing portion 60 and the lower housing portion 56, wherein the locking pin 18 is biased to the downward position 20 by the biasing mechanism 22 extending between the upper and lower housing portions 60, 56. The lower housing portion 56 can be in the form of a plunger 62 that incorporates both the lower housing portion 56 and the locking pin 18, where the lock rod 28 engages the underside 30 of the plunger 62. The underside 30 of the plunger 62 can engage the top surface 52 of the internal sheet metal 50 to define the downward position 20 of the plunger 62. It is contemplated that the internal locking pin 18 and the lower housing portion 56 can form a single plunger unit 62, or can be separate components that are attached. The upper housing portion 60 of the operable housing 16 can include an internal recess 70, sometimes referred to as a "dog house," that is at least partially defined by the receptacle 26. It is contemplated that the internal recess 70 can be a portion of the integral door lock indicator assembly 10 to be placed within the receptacle 26 of the interior door panel 24, such that the integral door lock indicator assembly 10 includes both upper and lower housing portions 60, 56 that can be inserted within the vehicle door 12 during manufacture.

According to various alternate embodiments, the internal recess 70 can be an integral part of the interior door panel 24, where the internal recess 70 is at least partially defined by the receptacle 26, and the internal recess 70 extends downward from the receptacle 26 to receive portions of the integral door lock indicator assembly 10. In such an embodiment, the upper housing portion 60 can be in the form of a grommet 72, as will be described more fully below.

Referring again to FIGS. 1-7, it is contemplated that the biasing mechanism 22 can be any one of various biasing members that can include, but are not limited to, return springs 80, foam members, cushioning members, spring steel, compressible members, elastic members, combinations thereof, and other similar biasing mechanisms 22 that can operate to bias the operable housing 16 to the downward position 20.

According to various embodiments, the rest position of the operable housing 16 that the biasing mechanism 22 operates toward can correspond to the downward position 20 indicating that the locking mechanism 34 is in the locked state 36. It is contemplated that the locking mechanism 34 of the vehicle door 12 may be in the locked state 36 more than it is in the unlocked state 38, as the vehicle door 12 is typically unlocked only during times around when the user goes into or leaves the vehicle 14. Many vehicles have automatic door locking actuators that automatically move to a locked state 36 when the vehicle 14 moves faster than a predetermined speed. Similarly, most users tend to lock their vehicle door 12 when they leave the vehicle 14 such that it is contemplated that the locking mechanism 34 may be in the unlocked state 38 intermittently and only for short periods of time. In such an embodiment, it is contemplated that the lock rod 28, when the locking mechanism 34 is moved to the unlocked state 38, forces the lock rod 28 upward such that the lock rod 28 moves the operable housing 16 toward the upward position 32, thereby overcoming the biasing force of the biasing mechanism 22 included within the integral door lock indicator assembly 10. Conversely, when the locking mechanism 34 is moved to the locked position, the lock rod 28 is moved downward such that the biasing force exerted by the biasing mechanism 22 moves the operable housing 16 to the downward position 20 to indicate that the door is locked.

According to the various embodiments, it is contemplated that the biasing mechanism 22 can be configured to bias the operable housing 16 toward the upward position 32 such that the lock rod 28 is attached to the operable housing 16 and operates to draw the operable housing 16 to the downward position 20 when the locking mechanism 34 is moved to the locked state 36. In such an embodiment, when the lock rod 28 is moved upward to indicate that the locking mechanism 34 is unlocked, the biasing mechanism 22 can assist in moving the lock rod 28 upward to provide the indication of the unlocked state 38.

Referring again to FIGS. 1-7, where the biasing mechanism 22 is a return spring 80, it is contemplated that the locking pin 18 can extend through the return spring 80. It is contemplated that the return spring 80 can be coupled to the operable housing 16 so that the operable housing 16 does not overextend beyond a desired operable limit. It is also contemplated that the biasing mechanism 22 being engaged with the operable housing 16 can assist in defining the integral door lock indicator assembly 10 as a unitary piece that can be pre-manufactured and installed, as a single unit, within a vehicle door 12 during manufacture of the vehicle door 12.

Referring again to FIGS. 1-7, it is contemplated that the upper housing portion 60 of the operable housing 16 can be defined by a grommet 72 that is received by the receptacle 26. In this manner, the grommet 72 can engage the receptacle 26 of the interior door panel 24 and can define a mating engagement with the receptacle 26 of the interior door panel 24. It is also contemplated that the grommet 72 can be attached to the receptacle 26 via various fasteners, adhesives, welding, combinations thereof, and other attachment methods and/or mechanisms.

Referring again to FIGS. 1-7, the grommet 72 can include a grommet aperture 90 through which an end cap 92 can be positioned. It is contemplated that the end cap 92 can extend over an end 94 of the locking pin 18 such that the end cap 92 and grommet 72 are the only visible features of the integral door lock indicator assembly 10 after manufacture of the vehicle door 12. As such, it is contemplated that the end cap 92 can include various aesthetic features, finishes, indicia, and other aesthetic appearances, as desired by the manufacture and/or the user. The end cap 92 can be placed upon the end 94 of the locking pin 18 via a threaded connection, adhesives, fasteners, and other similar attachment methods and/or mechanisms. It is also contemplated that the end cap 92 can be selectively removable after manufacture, such that a user can personalize their vehicle 14 by replacing the end cap 92 with another desired end cap 92 to provide a particular aesthetic desired by the user.

According to various embodiments, the end cap 92 can include an outward extending flange 96 (shown in FIG. 7) that can serve to prevent the grommet 72 and/or the upper housing portion 60 from sliding off from the end cap 92 during assembly, shipping or other phase of the process. The outward extending flange 96 can be a permanent piece of the end cap 92 or can be a shipping/assembly component that can be removed after the lock indicator assembly 10 is installed within the vehicle door 12.

According to various embodiments, as exemplified by FIGS. 1-7, the lock indicator assembly 10 for the vehicle door 12 can include the upper and lower housing portions 60, 56 that are biased away from one another to an extended state 100. When the lock indicator assembly 10 is installed within the vehicle door 12, the extended state 100 can correspond to the downward position 20 of the operable housing 16, as discussed above. The lock indicator assembly 10 can also include the locking pin 18 that extends from the lower housing portion 56 and extends through the upper housing portion 60. The upper and lower housing portions 60, 56 are operable to a compressed state 102 through operation of a compressive force exerted against an underside 30 of the lower housing portion 56, as the upper housing portion 60 remains stationary. Such a compressive force can be exerted by the lock rod 28 operating against the underside 30 of the lower housing portion 56 and the upper housing portion 60 being retained within the receptacle 26 of the interior door panel 24 of the vehicle door 12. In this manner, the compressed state 102 of the lock indicator assembly 10 can correspond to the upward position 32 when the lock indicator assembly 10 is installed within the vehicle door 12 and the lock rod 28 is operated against the underside 30 of the lower housing portion 56 and the lower housing portion 56 and the locking pin 18 are moved upward to provide the unlocked indicator.

Referring again to FIG. 7, it is contemplated that the biasing mechanism 22 can extend between the upper and lower housing portions 60, 56 to bias the upper and lower housing portions 60, 56 to the extended state 100, which corresponds to the downward position 20 of the lower housing portion 56 and the locking pin 18. The upper and lower housing portions 60, 56 can be moved toward one another to define a compressed state 102 that operates the locking pin 18 from the lowered or downward position 20 to the raised or upward position 32 with respect to the upper housing portion 60. In such an embodiment, the biasing mechanism 22 can be attached to one or both of the upper and lower housing portions 60, 56.

According to the various embodiments, the lock rod 28 can be free of attachment with the lower housing portion 56 of the operable housing 16, such that the lock rod 28, when moved upward, presses against the underside 30 of the lower housing portion 56, and when moved downward, allows the biasing mechanism 22 to bias the lower housing portion 56 to the downward position 20. It is further contemplated that the downward position 20 of the lock indicator assembly 10 can be defined by the extended state 100 of the biasing mechanism 22. Alternatively, as discussed above, the downward position 20 can be defined by the lower housing portion 56 engaging the internal sheet metal 50 within the vehicle door 12.

Figure 3:
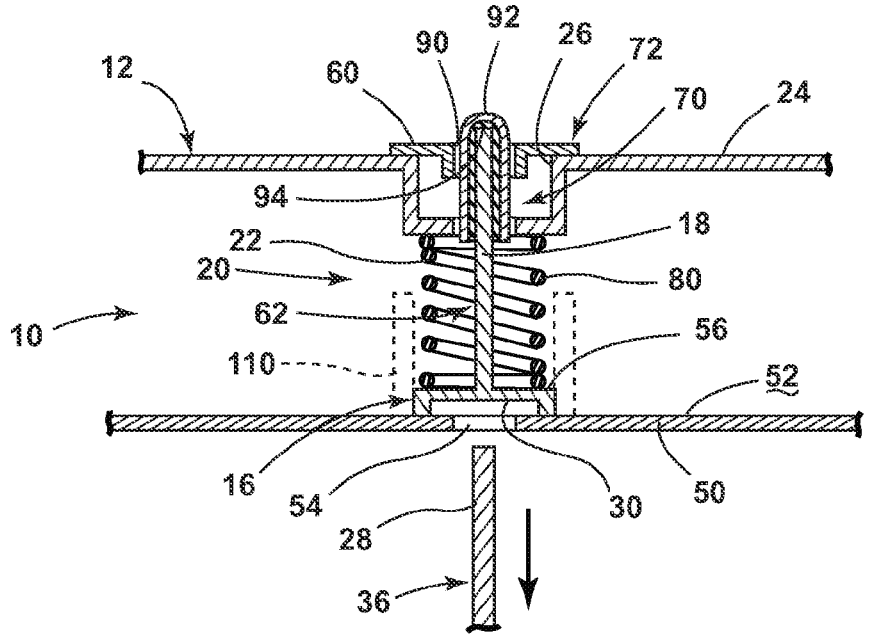
FIG. 3 is a cross-sectional view of an aspect of the door lock indicator assembly of FIG. 2 taken along line III-III and indicating the door locking mechanism as being locked.
Figure 4:
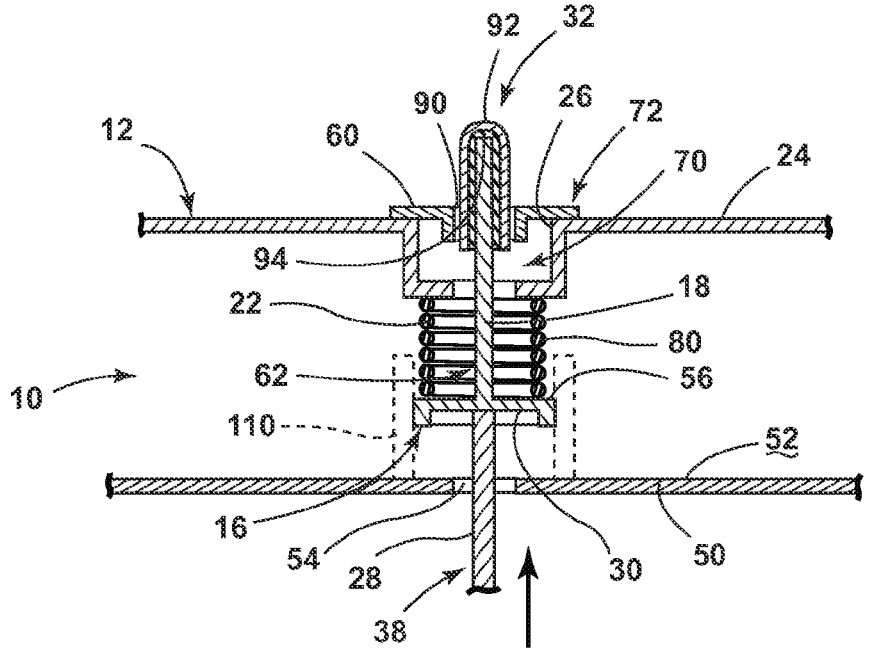
FIG. 4 is a cross-sectional view of the integral door lock indicator assembly of FIG. 3 shown in an upward position indicating that the locking mechanism is unlocked.
Figure 5:
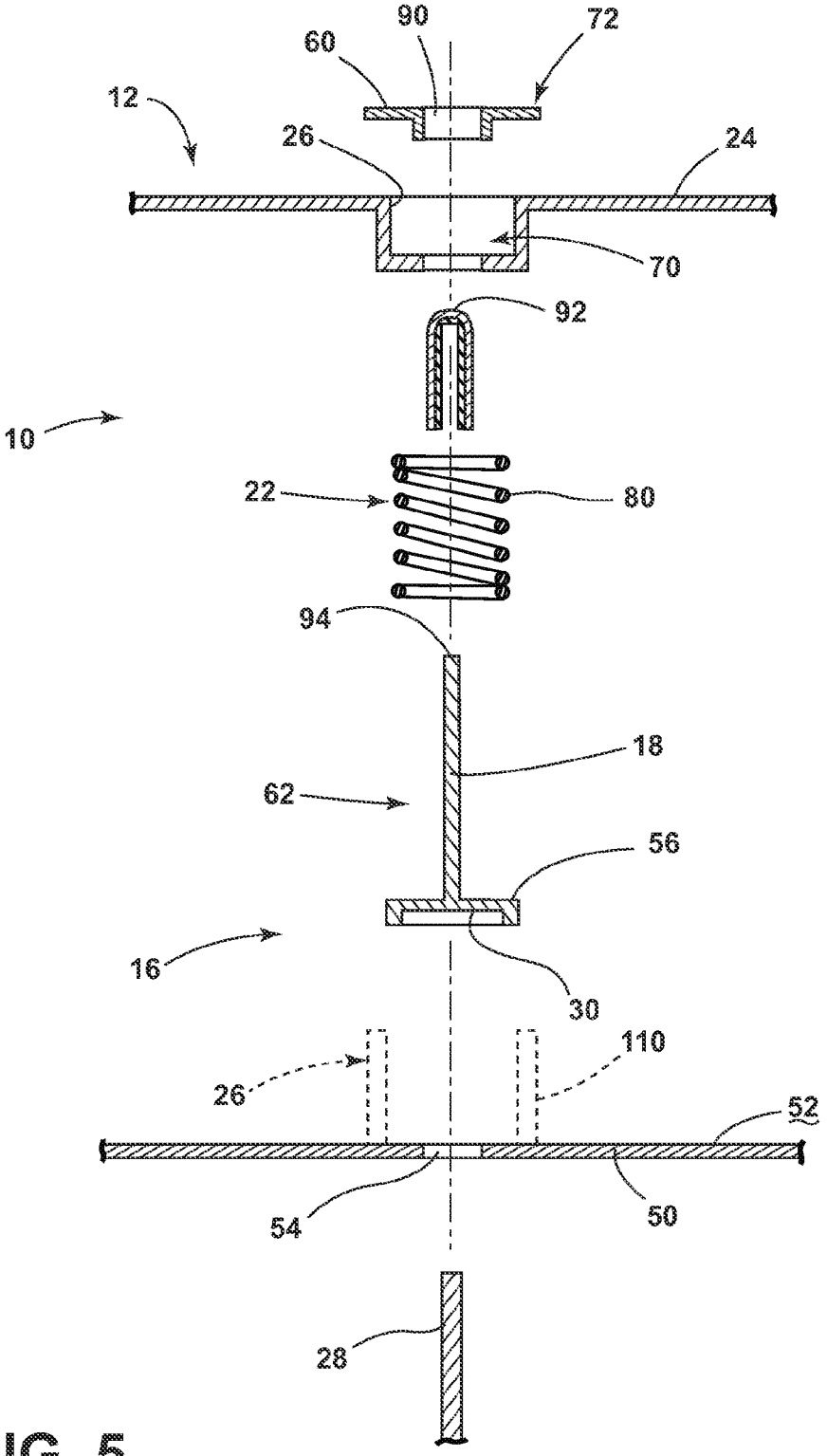
FIG. 5 is an exploded cross-sectional view of the integral door lock indicator assembly of FIG. 3.
Figure 6:
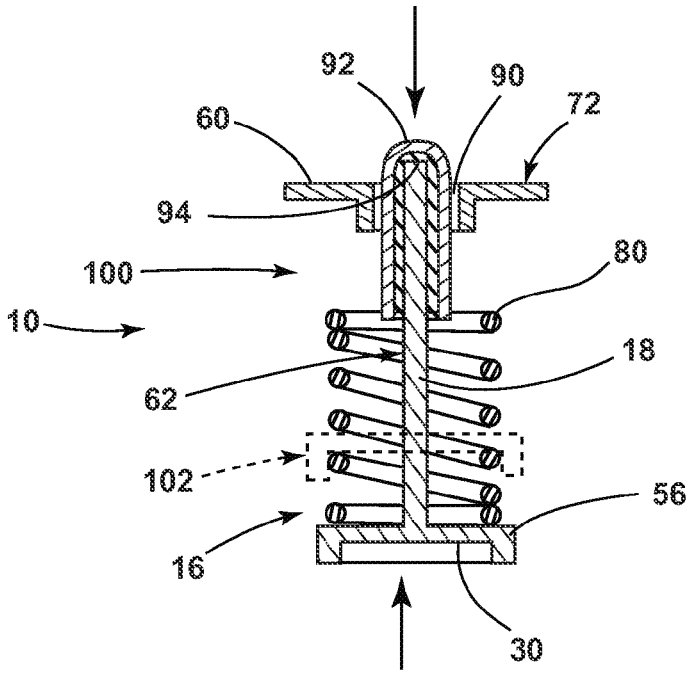
FIG. 6 is a cross-sectional view of an aspect of the integral door lock indicator assembly apart from the vehicle door.
Figure 7:
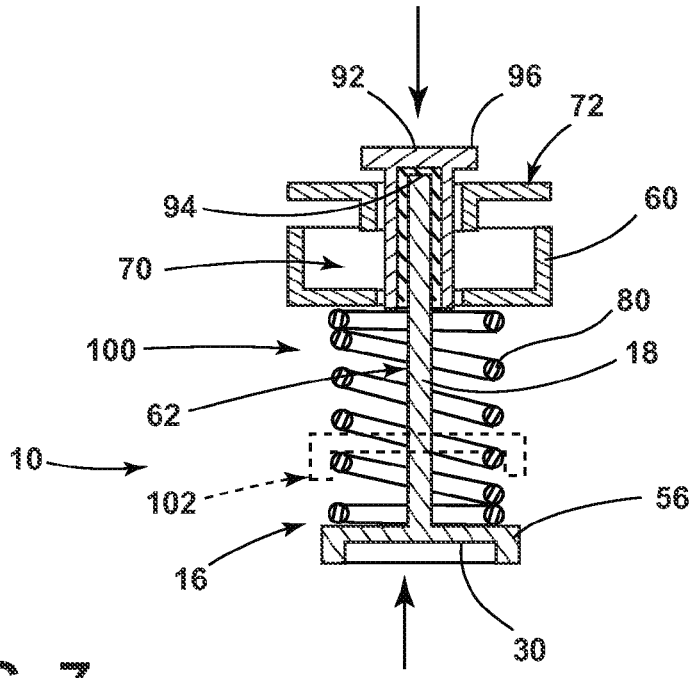
FIG. 7 is a cross-sectional view of an aspect of the integral door lock indicator assembly apart from the vehicle door.

According to various embodiments, as exemplified in FIGS. 3 and 4, the internal sheet metal 50 can include one or more alignment members 110 that guide the movement of the lower housing portion 56 of the operable housing 16 between the upward and downward positions 32, 20. In this manner, as the lock rod 28 engages the underside 30 of the lower housing portion 56, the alignment members 110 prevent sliding or other lateral displacement of the lower housing portion 56 as the lock rod 28 moves upward and operates the lower housing portion 56 from the downward position 20 to the upward position 32. The alignment members 110 also guide the movement of the lower housing portion 56 as the biasing mechanism 22 biases the lower housing portion 56 back toward the downward position 20 of the lock indicator assembly 10. The one or more alignment members 110 can also define a portion of the receptacle 26 that receives and secures the lock indicator assembly 10 within the vehicle door 12.

Figure 8:
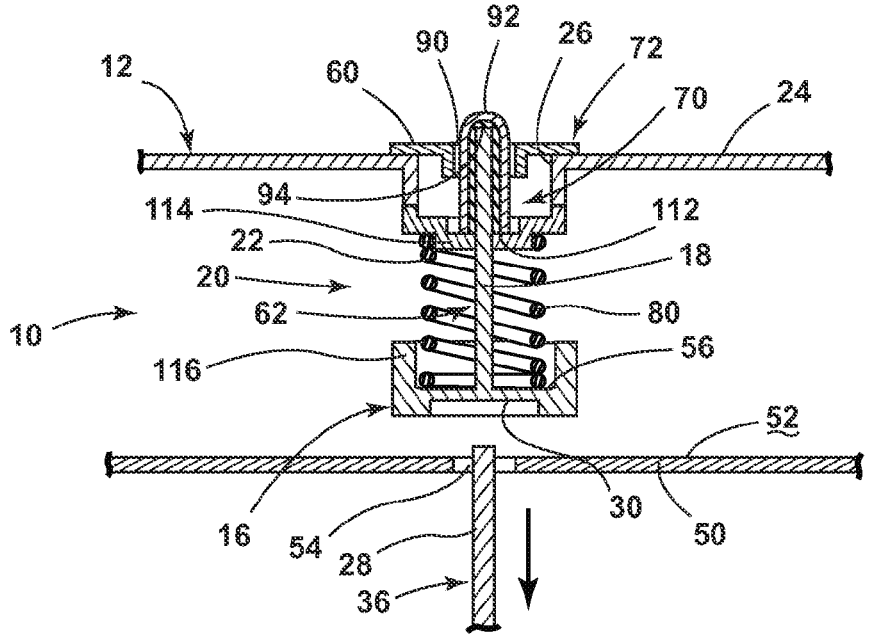
FIG. 8 is a cross-sectional view of an aspect of the integral door lock indicator assembly installed within a vehicle door and the operable housing in the downward position.
Figure 9:
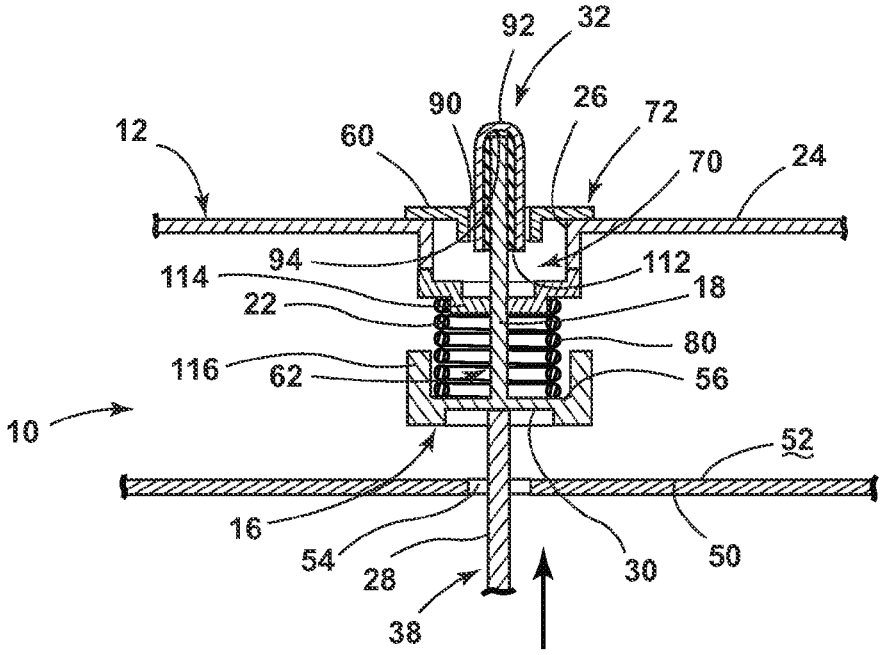
FIG. 9 is a cross-sectional view of the integral door lock indicator assembly of FIG. 8 shown with the operable housing in the upward position indicating that the locking mechanism is unlocked.
Figure 10:
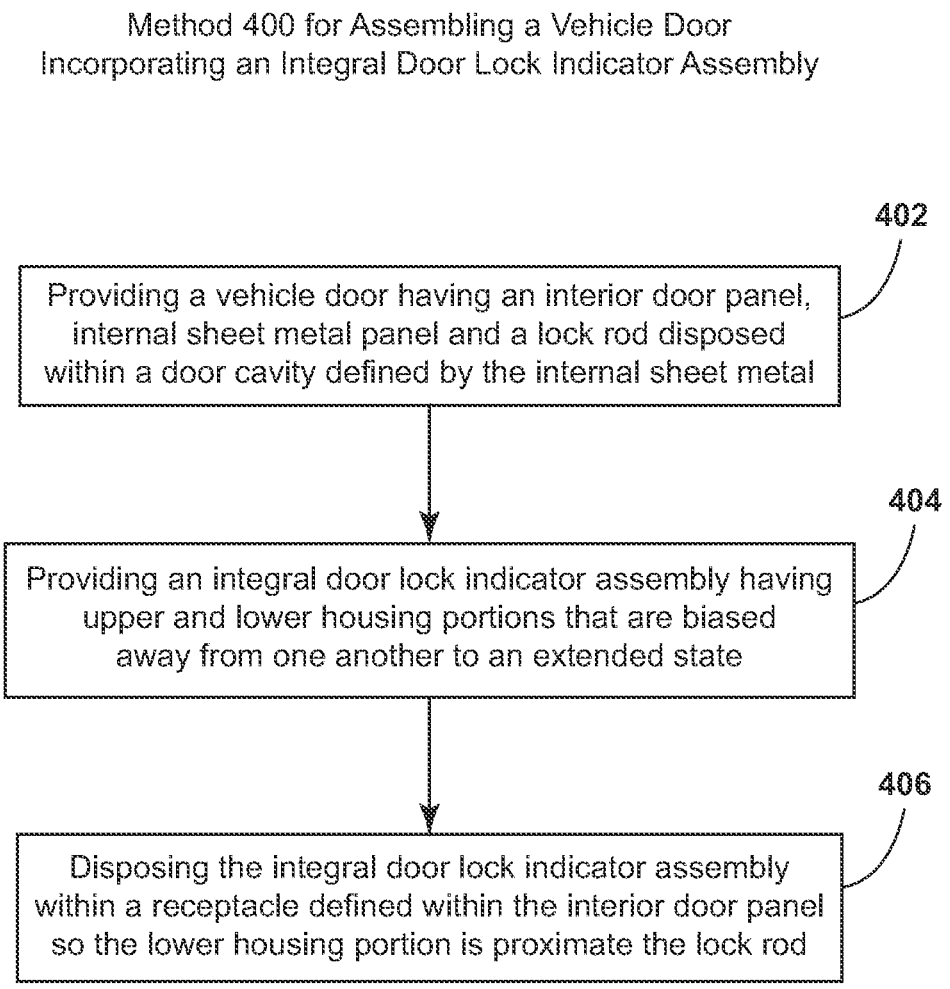
FIG. 10 is a schematic flow diagram exemplifying a method of assembling a vehicle door incorporating an aspect of the integral door lock indicator assembly.

Referring now to the various embodiments exemplified in FIGS. 8 and 9, it is contemplated that the lower housing portion 56 of the operable housing 16 for the lock indicator assembly 10 can define the downward position 20 without engaging the internal sheet metal 50. In such an embodiment, the lock indicator assembly 10 is engaged in a substantially fixed manner with the vehicle door 12 at the receptacle 26 defined within the interior door panel 24. The lower housing portion 56 is configured to be free of engagement with the interior sheet metal 50. In this manner, the lock rod 28 can be permanently positioned through the rod aperture 54 within the internal sheet metal 50, and the lock rod 28 operates above the internal sheet metal 50 to engage the underside 30 of the lower housing portion 56 to operate the lower housing portion 56 from the downward position 20 to the upward position 32.

Referring again to FIGS. 8 and 9, it is contemplated that the downward position 20 of the lock indicator assembly 10 can be defined by the extended state 100 of the biasing mechanism 22 and the lock indicator assembly 10. It is also contemplated that a portion of the lock indicator assembly 10 engages a portion of the interior door panel 24, such that the biasing mechanism 22 moves toward the extended state 100, but is prevented from doing so through engagement with a portion of the interior door panel 24. It is contemplated that a bottom portion 112 of the end cap 92 can engage a stop flange 114 defined within a portion of the receptacle 26. The stop flange 114 can define a bottom area of the internal recess 70. In this manner, as the biasing mechanism 22 biases the operable housing toward the extended state 100, the end cap 92 moves downward relative to the grommet 72 and the stop flange 114 of the receptacle 26. The bottom portion 112 of the end cap 92 engages the stop flange 114 and prevents further downward movement of the end cap 92, thereby defining the downward position 20 of the lock indicator assembly 10. It is contemplated that various alternate engagements between the vehicle door 12 and the lock indicator assembly 10 can operate to define the downward position 20 of the lock indicator assembly 10.

Referring again to FIGS. 8 and 9, the lower housing assembly 56 can include a spring retaining flange 116 that extends upward from the underside 30 of the lower housing portion 56. The spring retaining flange 116 can extend around at least a portion of the biasing mechanism 22 and serve as an attachment surface for at least a portion of the biasing mechanism 22. Additionally, it is contemplated that the spring retaining flange 116 can have a height sufficient to engage an underside of the receptacle 26, such that the engagement between the spring retaining flange 116 and the underside of the receptacle 26 can define the upward position 32 of the lock indicator assembly 10. It is also contemplated that the fully compressed state 102 of the biasing mechanism 22 for the lock indicator assembly 10 can define the upward position 32 of the lock indicator assembly 10. According to the various embodiments, it is contemplated that the spring retaining flange 116 can be a component of lock indicator assembly 10 that is installed within the receptacle 26 as a portion of the lock indicator assembly 10. In such an embodiment, it is contemplated that the stop flange 114 at least partially secures the lock indicator assembly 10 within the receptacle 26 to prevent unwanted movement of the lock indicator assembly 10 relative to the vehicle door 12.

Referring now to FIGS. 1-8, having described the integral door lock indicator assembly 10, a method 400 is disclosed for assembling a vehicle door 12 incorporating aspects of the integral door lock indicator assembly 10. According to the method, the vehicle door 12 can be provided having an interior door panel 24 and an internal sheet metal 50 and a lock rod 28 disposed within a door cavity defined by the internal sheet metal 50 (step 402). It is contemplated that the lock rod 28 is operated to selectively extend through the rod aperture 54 defined within the internal sheet metal 50. While the internal sheet metal 50 is described as being a sheet metal, the internal sheet metal 50 can be made of various materials that can include, but are not limited to, metal, metal alloy, plastic, composite, combinations thereof, and other various materials. The internal sheet metal 50 can be in the form of a panel, a series of individual combinations thereof or other similar structural configuration.

According to the method 400, an integral door lock indicator assembly 10 is provided having upper and lower housing portions 60, 56 that are biased away from one another to an extended state 100. A locking pin 18 extends from the lower housing portion 56 and through the upper housing portion 60 (step 404). It is contemplated that the biasing mechanism 22 can be disposed between the upper and lower housing portions 60, 56 to bias the upper and lower housing portions 60, 56 to the extended state 100. The biasing mechanism 22 can be engaged with one or both of the upper and lower housing portions 60, 56, typically engaged and directly attached to the lower housing portion 56.

Referring again to FIGS. 1-8, the integral door lock indicator assembly 10 can be disposed within a receptacle 26 defined within the interior door panel 24 (step 406). In this manner, the lower housing portion 56 is positioned proximate the lock rod 28, where the upper and lower housing portions 60, 56 are operable to a compressed state 102 through operation of the lock rod 28 against the underside 30 of the lower housing portion 56. The upward motion of the lock rod 28 presses the lower housing portion 56 to the compressed state 102 and moves a locking pin 18 to the upward position 32. The downward movement of the lock rod 28 allows the lower housing portion 56 being biased back toward the extended state 100, such that the locking pin 18 is moved to the lowered or downward position 20. As discussed above, the lock rod 28 can be engaged with the locking mechanism 34 of the vehicle door 12, such that as the locking mechanism 34 is moved between the locked and unlocked positions, the lock rod 28 moves downward and upward, respectively, to operate against the operable housing 16 of the integral door lock indicator assembly 10.

It is contemplated that the integral door lock indicator assembly 10 can be installed within various vehicle doors 12 that can include, but are not limited to, front doors, rear doors, tailgates, access panels, hoods, combinations thereof, and other similar locations that have a locking mechanism 34 incorporated therein.

According to the various embodiments, the integral nature of the lock indicator assembly 10 can speed up the manufacturing process by allowing the integral door lock indicator assembly 10 to be manufactured in one location, and be transferred to the assembly location for the vehicle door 12. In this manner, the integral door lock indicator assembly 10 can be inserted within the vehicle door 12 as a single piece, such that the smaller components of the lock indicator assembly 10 can be installed within the vehicle door 12 quickly and efficiently, thereby speeding up the manufacturing process. Additionally, quality control checks of the lock indicator assembly 10 can be performed before the lock indicator assembly 10 is installed within the vehicle door 12 such that quality control issues can be minimized during manufacture of the vehicle 14.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A vehicle door lock indicator assembly comprising:

upper and lower housing portions biased away from one another to an extended state; and a locking pin extending from the lower housing portion and through the upper housing portion, wherein the upper and lower housing portions are operable to a compressed state through operation of a lock rod against an underside of the lower housing portion.

2. The vehicle door lock indicator assembly of claim 1, further comprising:

a biasing mechanism extending between the upper and lower housing portions and biasing the upper and lower housing portions to the extended state, wherein the extended state corresponds to a lowered position of the locking pin, and wherein movement of the upper and lower housing portions to the compressed state operates the locking pin from the lowered position to a raised position corresponding to the compressed state.

3. The vehicle door lock indicator assembly of claim 2, wherein the biasing mechanism is a return spring and the locking pin is attached to the lower housing portion and extends through the return spring.

4. The vehicle door lock indicator assembly of claim 2, wherein the upper housing portion includes a grommet aperture through which the locking pin operates to define the lowered and raised positions, and wherein the grommet aperture is secured within a door panel, wherein the upper housing portion is stationary with respect to the door panel.

5. The vehicle door lock indicator assembly of claim 2, further comprising:

an internal sheet metal offset from an interior door panel, wherein the lower housing portion engages a top surface of the internal sheet metal to define the lowered position of the locking pin.

6. The vehicle door lock indicator assembly of claim 1, wherein the locking pin includes an end cap that extends over an end of the locking pin.

7. The vehicle door lock indicator assembly of claim 6, wherein an internal sheet metal is offset from an interior door panel, and wherein the internal sheet metal includes a rod aperture, through which the lock rod extends to operate the lower housing portion to define the extended and compressed states, and wherein a bottom portion of the end cap engages a portion of the interior door panel to define the lowered position of the locking pin.

8. The vehicle door lock indicator assembly of claim 1, wherein the lock rod is free of attachment to the underside of the lower housing portion.

* * * * *